US009671206B2

(12) United States Patent
Schlenter

(10) Patent No.: US 9,671,206 B2
(45) **Date of Patent: *Jun. 6, 2017**

(54) TWO WIRE DAISY CHAIN

(71) Applicant: DETNET SOUTH AFRICA (PTY) LTD, Woodmead (ZA)

(72) Inventor: Craig Charles Schlenter, Woodmead (ZA)

(73) Assignee: DETNET SOUTH AFRICA (PTY) LTD, Woodmeed (ZA)

( * ) Notice: Subject to any disclaimer, the term of this patent is extended or adjusted under 35 U.S.C. 154(b) by 15 days.

This patent is subject to a terminal disclaimer.

(21) Appl. No.: 14/881,101

(22) Filed: Oct. 12, 2015

(65) Prior Publication Data

US 2016/0033247 A1 Feb. 4, 2016

Related U.S. Application Data

(62) Division of application No. 13/582,688, filed as application No. PCT/ZA2011/000025 on Apr. 18, 2011, now Pat. No. 9,157,719.

(51) Int. Cl.

| | |
|---|---|
| ***F42C 21/00*** | (2006.01) |
| ***F42C 19/06*** | (2006.01) |
| ***F42D 1/045*** | (2006.01) |
| ***F42D 1/05*** | (2006.01) |
| ***F42D 1/055*** | (2006.01) |

(52) U.S. Cl.

CPC ..... *F42C 19/06* (2013.01); *F42D 1/045* (2013.01); *F42D 1/05* (2013.01); *F42D 1/055* (2013.01)

(58) Field of Classification Search

USPC ..... 102/206, 215, 200, 202.5, 322; 361/248, 361/249; 439/488, 620.01, 894

See application file for complete search history.

(56) References Cited

U.S. PATENT DOCUMENTS

| | | | | |
|---|---|---|---|---|
| 4,846,066 | A | 7/1989 | Beattie et al. | |
| 5,997,343 | A * | 12/1999 | Mills | A61B 5/14552 29/825 |
| 6,966,262 | B2 | 11/2005 | Jennings, III | |
| 7,617,775 | B2 | 11/2009 | Teowee | |
| 7,694,627 | B2 | 4/2010 | Koekemoer et al. | |
| 7,911,760 | B2 | 3/2011 | Lownds | |
| 8,582,275 | B2 | 11/2013 | Yan et al. | |
| 9,157,719 | B2 * | 10/2015 | Schlenter | F42D 1/045 |
| 2005/0122201 | A1 * | 6/2005 | Davis | G08B 29/24 337/53 |
| 2006/0273661 | A1 * | 12/2006 | Toebes | G06F 1/266 307/106 |
| 2010/0288149 | A1 | 11/2010 | Schlenter | |
| 2011/0121654 | A1 * | 5/2011 | Recker | H02J 9/065 307/66 |

FOREIGN PATENT DOCUMENTS

| | | |
|---|---|---|
| ZA | 200906238 | 5/2010 |

OTHER PUBLICATIONS

International Search Report and Written Opinion for Application No. PCT/ZA2011/000025 dated Sep. 6, 2011 (10 pages).

* cited by examiner

*Primary Examiner* — J. Woodrow Eldred

(74) *Attorney, Agent, or Firm* — Michael Best & Friedrich LLP

(57) ABSTRACT

A detonator which, in response to a command, uses a first modulation process to generate a first signal and, in response to an event, uses a second modulation process to generate a second signal.

7 Claims, 3 Drawing Sheets

TWO WIRE DAISY CHAIN

CROSS-REFERENCE TO RELATED APPLICATIONS

This application is a divisional of co-pending U.S. patent application Ser. No. 13/582,688 filed on Sep. 4, 2012, which is a national stage entry under 35 U.S.C §371 of International Patent Application No. PCT/ZA2011/000025 filed on Apr. 18, 2011, which claims priority to South African Patent Application No. 2010/03087 filed May 4, 2010. The entire contents of each of the foregoing applications are incorporated herein by reference.

BACKGROUND OF THE INVENTION

This invention relates to a detonator system and to a detonator and a connector for use in a detonator system.

An electronic detonator system can be constructed in different ways. In one approach use is made of a plurality of identifiable detonators which are connected to a two-wire bus. The unique identity of each detonator allows the individual detonators to be correctly addressed.

In another approach use is made of a so-called "daisy chain" in which the wiring order of the detonators is established by control equipment connected to a multi-wire bus. The wiring order is important for it allows each detonator to be distinguished from the others.

In certain blasting situations, particularly where regular timing delays are programmed into each detonator, the connection order of detonators can be used to establish a blast timing pattern, and a daisy chain system may be preferable in this application. A drawback is that, generally, three or four wires are required to make suitable connections to the detonators. The cost per detonator in this type of system is often higher than in a similar two-wire system. Reliability is also adversely impacted as the use of more wires requires correspondingly more connections and this increases the prospect of connectivity problems.

PCT/AU2006/000315 describes an electronic blasting system in which detonators are connected to a surface harness by two-wire leads. A respective actuator is positioned between each adjacent pair of detonators. The actuator is responsive to a command signal from a control unit. This means that the actuator must possess the capability to identify, and then respond to, the command signal which may be one of a plurality of possible signals. The inherent requirement for intelligence on-board the actuator increases the complexity of the actuator and thus increases the cost of a detonator system based on the use of a plurality of the actuators.

U.S. Pat. No. 4,846,066 discloses detonators which are connected so that programming signals will only be received by a given detonator when an adjacent detonator, nearer to a signal output, has been programmed. This is achieved by making use of a respective connector which is associated with each detonator and which includes a switching device which is operated by a logic element. Signals can only pass beyond a connector when a detonator which is associated with that connector has been programmed. To do this an additional wire is presumed to be required between the detonator and the connector. This feature increases the cost, and decreases the reliability, of a detonator system which makes use of this technique. The patent specification is silent regarding the use of the detonator wires for the transmission of logic signals.

ZA2009/06238 describes a system in which two-wire detonators are connected successively to a two-wire bus with appropriate connectors. Each connector includes a timer which initiates a timing interval and a switch, responsive to an end of the timing interval, to effect an electrical connection between control equipment and a detonator associated with the connector. This approach, which allows the detonators to be enumerated (identified), is relatively slow since the duration of the time interval, typically nominally the same for each connector, must permit for possible multiple communication attempts on the bus, before a following detonator is connected, to ensure that the system can function in noisy signal environments. Also, the control equipment is unable to effect a change in state of a connector even if communication with an associated detonator is successful on a first attempt.

An object of the present invention is to provide a detonator system wherein detonators and connectors can be connected to a two-wire bus without the passing of a time interval of fixed duration between successive connections.

Another object is to provide a low-cost connector of relatively simple construction for use in a detonator system.

SUMMARY OF THE INVENTION

The invention provides, in the first instance, a detonator which includes a circuit which, in response to at least one command on a two-wire bus, generates a first signal using a first modulation process and, upon occurrence of at least one designated event, generates a second signal, using a second modulation process, which is distinguishable from the first signal.

The circuit may, upon occurrence of a further event, generate a third signal, using a third modulation process, which is distinguishable from the first and second signals.

Each modulation process may be based on use of any appropriate modulation technique. Preferably though for practical and cost reasons each modulation process is based on the use of current modulation and, to enable one signal to be distinguished from another, the amplitude of the current of each signal is varied in a controlled manner.

The first modulation process may result in a signal having a relatively low current amplitude. The second modulation process may result in a signal having a substantially higher current amplitude which is readily distinguishable from the low current amplitude.

The invention provides, in the second instance, a connector, for connecting a detonator to a two-wire bus, which includes a sensor and a switch which is operable in response to the sensor, wherein the detonator is capable of generating a first signal using a first modulation process and, in response to occurrence of at least one designated event, of generating a second signal using a second modulation process and wherein the first signal is distinguishable, by the sensor, from the second signal on the basis of the modulation processes used in the generation of the signals, e.g. on the basis of the relative amplitudes of the signals.

The sensor may cause operation of the switch, in a desired way, only upon detection of the second signal by the sensor. The action of the switch may affect one or both wires of the two-wire bus i.e. only one wire is open-circuited and then closed, or both wires are open-circuited and then closed.

Each modulation process may be based on any appropriate modulation technique. Preferably for practical and cost reasons each modulation process is based on current modulation. For example the first signal may have a current amplitude at a relatively low level and the second signal may have a current amplitude at a relatively high level which is clearly distinguishable from the first level.

The invention also provides an electronic detonator system which includes an elongate two-wire bus, at least one detonator of the aforementioned kind and at least one connector of the aforementioned kind which connects the detonator to the two-wire bus.

In the system the detonator may be capable of responding to commands on the two-wire bus, emanating for example from control equipment connected to the bus, by generating a first signal using the first modulation process and, upon occurrence of the at least one designated event, by generating a second signal using the second modulation process.

In a preferred form of the invention the detonator, in response to a signal, e.g. a command signal, from the control equipment generates a first signal at a first level of current modulation and, upon occurrence of at least one designated event in, or notified to, the detonator, generates a second signal at a second level of current modulation which is higher than the first level.

The switch in the connector may be responsive only to the signal at the higher level of modulation.

The level of current modulation may be detected in the connector by means of at least one resistor which is in series with the detonator.

The switching action of the switch in the connector may be implemented through the use of field effect transistors, or of any other appropriate switching means.

The switch in the connector may be latched, or toggled, according to requirement, in response to the second signal from the detonator i.e. the signal which is at the higher level of modulation.

It is also possible for the detonator to generate a third signal which is distinguishable on the basis of the level of current modulation of the third signal, from the first and second signals. The third signal may be used to change the state of the switch e.g. open to closed, or vice versa.

The designated event which initiates the generation of the second signal at the higher level of current modulation may be any appropriate event related to the effective or desired mode of operation of the detonator system. Without being limiting the event may be one or more of the following:

a) the end of a sequence of commands to the detonator from the control equipment;
b) reception of a command, by the detonator, that is not addressed to the detonator by the control equipment;
c) a state change in the detonator. The state change may be one or more of the following:
   i) the assignment of an identity to the detonator;
   ii) the reading of a detonator identifier;
   iii) the programming of the detonator; and
   iv) the assignment of a time delay to the detonator;
d) an instruction from the control equipment to the detonator to activate or deactivate at least one switch in the connector;
e) the expiry of a time period during which no commands are received by the detonator; and
f) a variation (decrease or increase) in the average voltage level on the two-wire bus.

In a different form of the invention the connector includes first and second switches which are respectively responsive to signals from the detonator which have different levels of current modulation.

BRIEF DESCRIPTION OF THE DRAWINGS

The invention is further described by way of examples with reference to the accompanying drawings in which.

DESCRIPTION OF PREFERRED EMBODIMENTS

Figure 1:
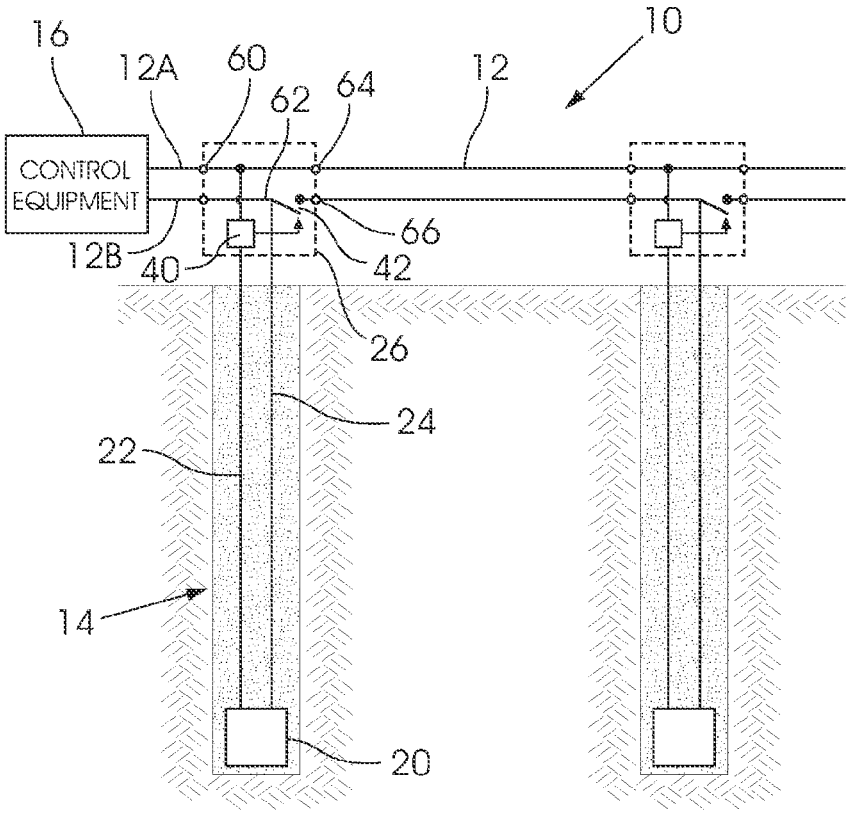
FIG. 1 illustrates a detonator system according to the invention.

FIG. 1 of the accompanying drawings illustrates a detonator system 10 according to the invention which includes a surface harness in the form of an elongate two-wire bus 12 which extends to a plurality of boreholes 14 in rock at a site which is to be blasted. The bus 12 is connected to control equipment 16 which is used to control the blasting process. Each borehole contains a respective detonator 20 which is connected via two wires 22 and 24, through the medium of an appropriate connector 26, shown in dotted outline in each instance, to the two-wire bus 12.

Figure 2:
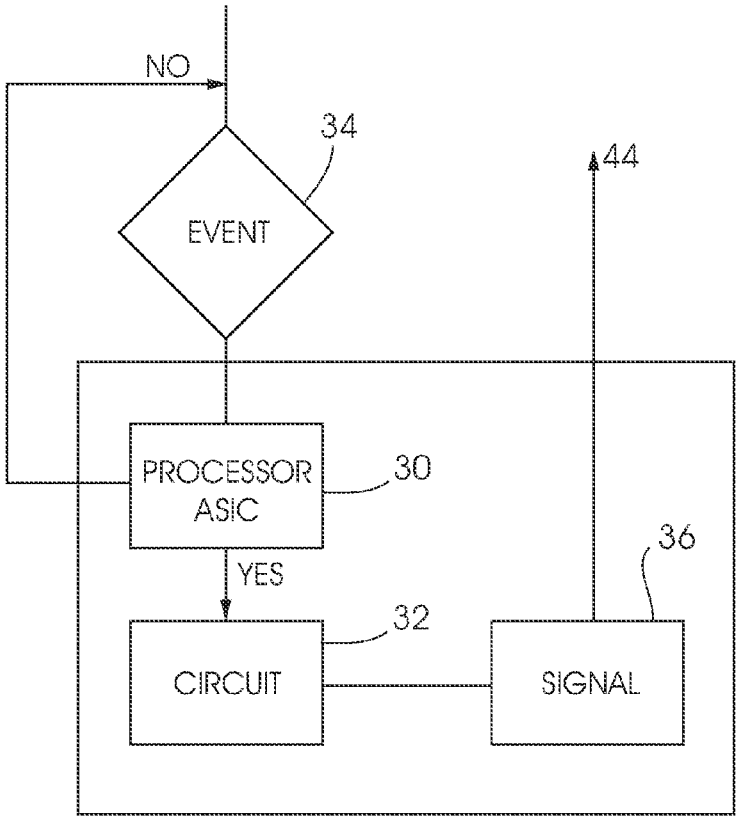
FIG. 2 is a block diagram representation of certain electronic components in a detonator included in the detonator system.

FIG. 2 illustrates in block diagram form certain components in a detonator 20. The detonator has a processor or asic 30 and a circuit 32 which may be distinct from the processor/asic or which may be incorporated in the processor/asic. The circuit 32, in response to the detection by the processor/asic of at least one designated or predetermined event 34, produces an output signal 36.

The connector 26 includes a sensing circuit 40 (shown in block form in FIG. 1) and at least one switch 42 which is operable by the sensing circuit under certain conditions as is described hereinafter. The operation of the connector is described, firstly, in general terms and then in more detail with specific reference to FIG. 4 which is a diagram of a circuit in the connector.

In the detonator system 10 the bus 12 has two wires 12A and 12B only Each detonator is connected by means of two wires 22, 24 only to the bus via a corresponding connector 26. Once all the detonators have been connected to the bus the control equipment 16 transmits a first command signal on the bus.

The first command signal is received by the first detonator i.e. the detonator which is closest to the control equipment. The remaining detonators, which are downstream from the first detonator, are isolated from the first command signal because the switch 42, in the first connector, is open. An identity number can be assigned to, or can be read from, the first detonator and validation or other checks can be done on the first detonator. The first detonator can also be programmed at this stage, if required. The specifics of the detonator command sequences are not considered further herein as these are well known in the art and are dependent, inter alia, on the design of the detonator.

Figure 3:
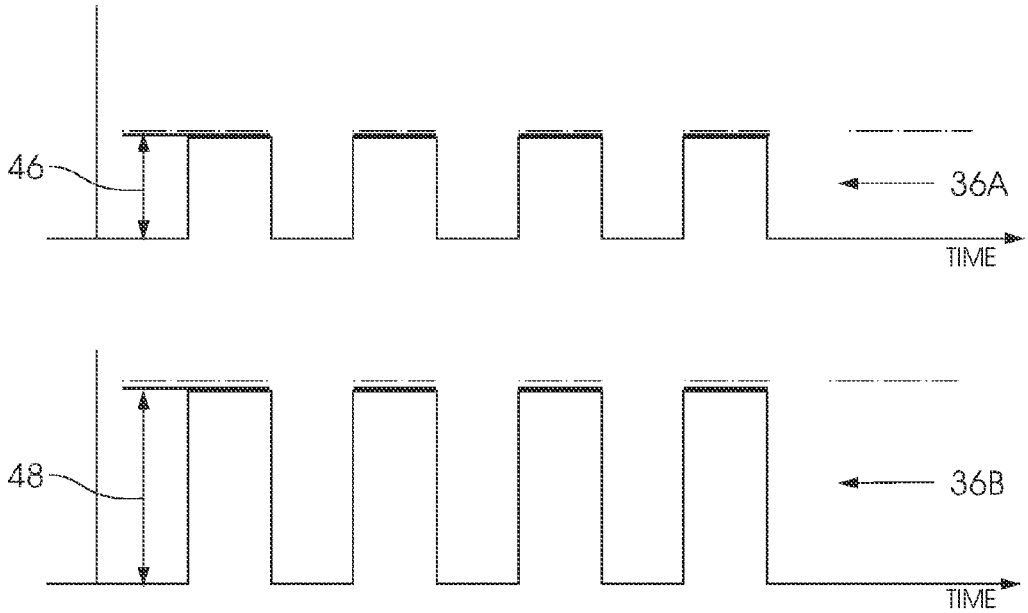
FIG. 3 illustrates typical signals at different levels of current modulation produced by a detonator in the system.

Commands to the first detonator from the control equipment are processed by the processor 30 in the detonator. A signal 36, in response to the commands, is generated by the circuit 32 using techniques which are known in the art. The signal 36, shown in a representative manner only in FIG. 3, is at a first level of current modulation and comprises a plurality of pulses 36A (FIG. 3). Each pulse has a relatively low level 46 of current amplitude and the sensing circuit 40 is not responsive thereto. The pulses 36A thus pass through the connector 26, from the detonator to the control equipment 16, without any effect on the sensing circuit 40. In this manner secure and effective two-way communication between the control equipment and the first detonator is established.

Assume that at least one designated event occurs. This event may be selected for the purpose and, by way of example only, may be one or more of the following:

a) the end of a sequence of commands to the detonator from the control equipment;
b) reception of a command, by the detonator, that is not addressed to the detonator by the control equipment;
c) a state change in the detonator. The state change may be one or more of the following:
   i) the assignment of an identifier to the detonator;
   ii) the reading of a detonator identifier;
   iii) the programming of the detonator; and
   iv) the assignment of a time delay to the detonator;
d) an instruction from the control equipment to the detonator to activate or deactivate at least one switch in the connector;
e) the expiry of a time period during which no commands are received by the detonator; and
f) a variation (decrease or increase) in the average voltage level on the two-wire bus.

For example validation checks may have been carried out successfully on the first detonator and an identifier may have been assigned to the first detonator. When this occurs the processor 30 (in the first detonator) actuates the circuit 32 to produce a second output signal 36B (see FIG. 3) which has a level 48 of current modulation which is significantly higher than the level 46 of current modulation for the first signal 36A. The sensing circuit 40 in the connector is responsive to the higher level of current modulation and, upon detecting the signal 36B, the circuit 40 causes closure of the corresponding switch 42 (referring to FIG. 1). The control equipment can then address the second detonator in the sequence in a unique and secure manner. Command signals directed to the second detonator are prevented from reaching the first detonator through the use of suitable links.

For example a command signal may be uniquely linked to the first or second detonator, or to the state of the first or second detonator, in a way which ensures that the signal can only reach the second detonator.

The aforementioned process continues in succession down the two-wire bus. Each detonator thus, in sequence, is uniquely and directly addressable by the control equipment 16 in a manner which allows for secure bidirectional communications. Each detonator, in turn, is uniquely identified. Upon the occurrence of a designated or predetermined event at each detonator the following detonator is enabled in the sense that it is connected to the control equipment by closure of the switch in the preceding connector. An inherent time delay of a minimum duration is not associated with each connector and switch closure takes place in the shortest possible time.

The switch 42, in the illustrated example, is closed by the second signal 36B which is generated by the circuit 32 of the associated detonator upon detection of a predetermined event by the associated processor/asic 30. It is possible for the circuit 32 to generate a third signal, not shown, at a level of modulation which is distinct from the levels 46 and 48. The sensor 40, or an additional sensor, could be responsive to the third signal and this could be used to open the switch 42.

Figure 5:
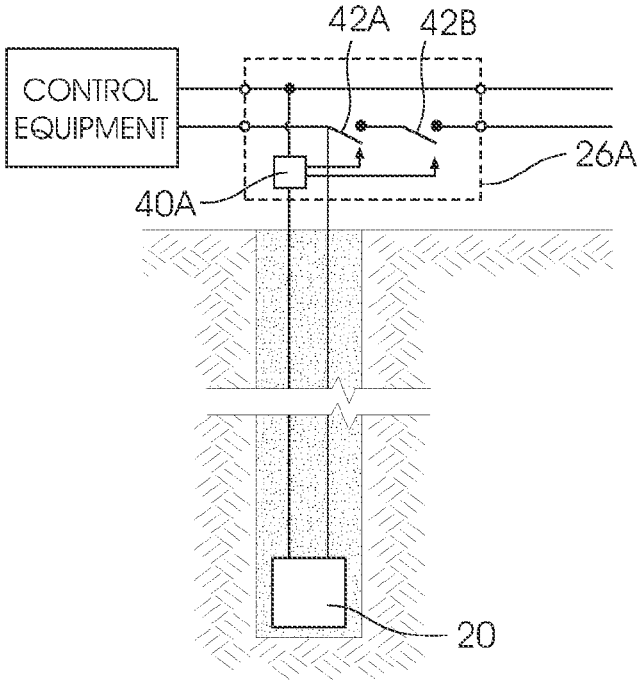
FIG. 5 shows a possible variation to the invention.

In a variation of the invention (shown in FIG. 5) each connector (marked 26A) includes two switches 42A and 42B respectively, each of which is responsive to a signal from the circuit 32 with a respective degree of modulation. The switches 42A and 42B are in series and, in this event, at least two predetermined events would have to be detected for both switches to be closed and to be kept closed so that a succeeding detonator could be connected to the control equipment.

Figure 4:
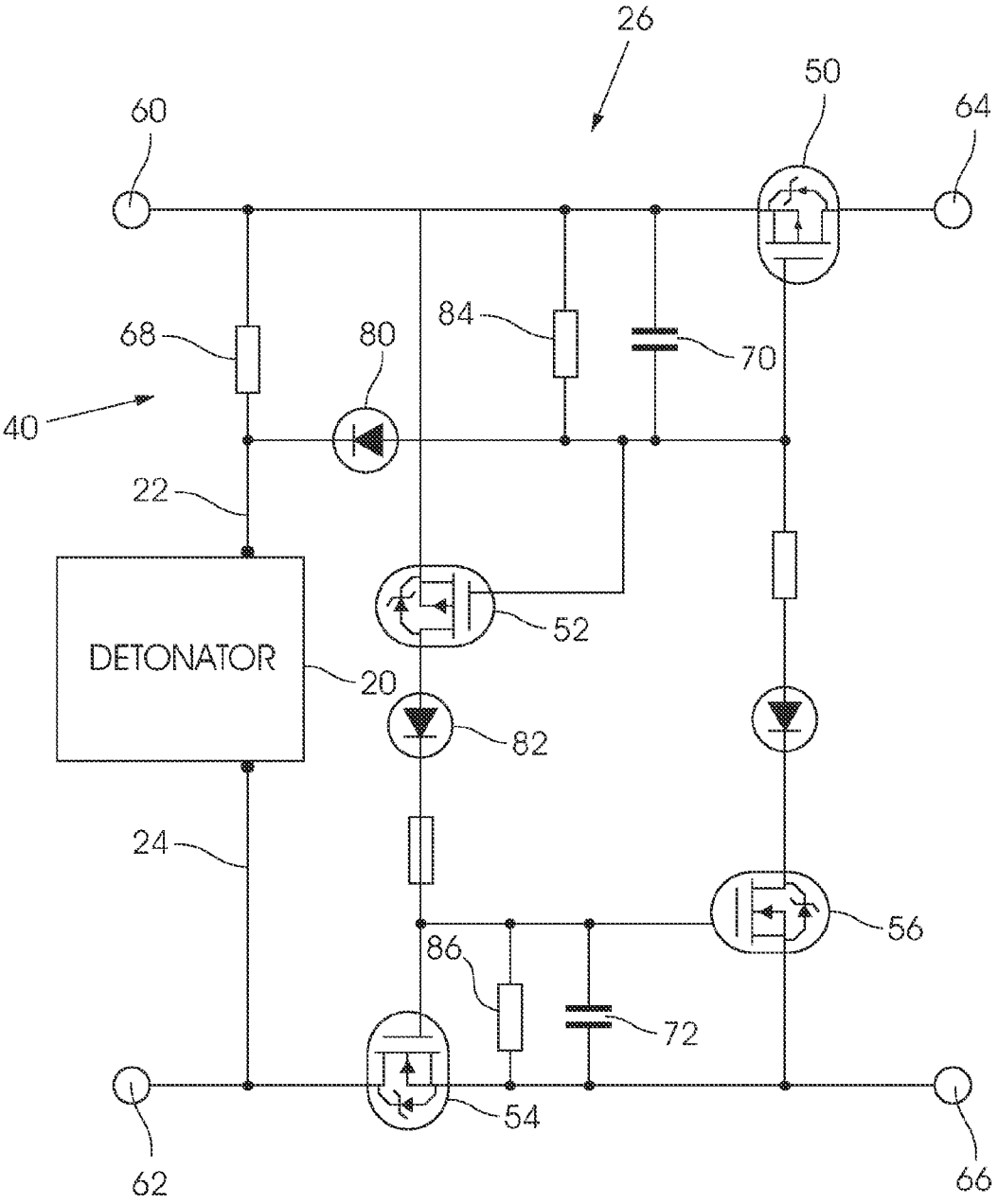
FIG. 4 illustrates a circuit in a connector used in the detonator system.

FIG. 4 is a circuit diagram of a detonator 20 and a connector 26 which, as noted, includes a sensing circuit 40 and at least the first switch 42.

The connector circuit includes four field effect transistors 50, 52, 54 and 56 respectively (which are used to implement the switching action of the switch 42, notionally shown in FIG. 1), input terminals 60 and 62, and output terminals 64 and 66 respectively. A resistor 68 is connected in line with the wire 22 to the detonator 20.

A capacitor 70 is connected across the gate and source of each of the transistors 50 and 52 respectively. A capacitor 72 is connected across the gate and source of each of the transistors 54 and 56 respectively.

Assume that the terminal 60 is positive with respect to the terminal 62. The current to the detonator 20 passes through the resistor 68. In normal operation, or during talk back from the detonator to the control equipment 16, the voltage developed across the resistor 68 is insufficient to switch either of the transistors 50 and 52 on. Thus the transistors 54 and 56 are held off. As a result voltage modulated signals, from the control equipment 16 to the detonator, that are present at the terminals 60 and 62 are not present at the terminals 64 and 66, i.e. the switch 42 (shown in FIG. 1) is effectively off.

If the detonator draws a higher current then the voltage across the resistor 68 increases and the transistors 50 and 52 are turned on. When the transistor 52 turns on the transistor 54 turns on and so does the transistor 56. The transistor 56, when turning on, produces a latching action in that the transistor 50 is held on even though the voltage across the resistor 68 might drop below the initial high value at which the transistors 50 and 52 were turned on. The voltage across the resistor 68 would drop in this way when the high current consumption or sink of the detonator 20 terminates.

At this stage each of the transistors 50 to 56 is conducting. This remains the case even for brief alternate polarity signalling on the terminals 60 and 62 for the capacitors 70 and 72 respective hold the transistors 50 and 54 on.

Consequently a signal which is presented at the terminals 60 and 62 is present at the terminals 64 and 66. If power is removed from the terminals 60 and 62, or if the polarity of the signal applied to these terminals is reversed for a sufficiently long period to allow either of the capacitors 70 and 72 to discharge, the switch (42) embodied in the connector opens. Diodes 80 and 82 prevent the capacitors 70 and 72 from discharging forcibly if the polarity at the terminals 60 and 62 is reversed by the control equipment. These capacitors normally discharge via resistors 84 and 86 which are connected in parallel with the capacitors, with a polarity reversal or if power is removed.

In the circuit shown in FIG. 4 switching is effected in both wires 12A and 12B of the two-wire bus. The circuit of the connector can however be reconfigured to use fewer components or to effect switching in only one of the wires 12A and 12B.

The principles described herein can be used, with substantial benefit, in conjunction with known techniques in the art and, in particular, in combination with the markers which are described in the specification of International Patent Application No. PCT/ZA2004/00079 to provide flexible or various time delays to the detonators or to adjust these time delays. Clearly time assignments or delays can be transmitted from the control equipment 16 to respective detonators.

In FIG. 1 the two-wire bus 12 is shown as a separate component. This however is not necessarily the case for the bus could be formed as part of the harnesses or wires 22 and 24 which extend to the respective detonators.

The functioning of the connector 26 is preferably carried out by means of circuitry included in a housing of the connector. An equivalent effect, which is intended to fall within the scope of the present invention, can however be achieved by providing suitable circuitry in an appropriate module which is associated with the detonator wires 22, 24, if required.

In the arrangement shown in FIG. 1 it is assumed that the two-wire bus 12 is laid out and that, when a connector is coupled to the bus, a break in one of the wires (in the illustrated example the wire 12B) is made. This is in accordance with the techniques described in the specification of South African Patent Application No. 2009/06238. This is not necessarily the case for in an alternative arrangement suitable lengths of the two-wire bus are connected individually between respective adjacent pairs of connectors.

The circuit shown in FIG. 4 is polarity-sensitive in that the terminal 60 must be positive with respect to the terminal 62 during switching. It is possible though, to reconfigure the circuit so that it can function in a polarity-insensitive manner.

The invention claimed is:

1. A connector for connecting a detonator to a two-wire bus, wherein the connector includes a sensor and at least a first switch which is operable in response to the sensor, wherein the sensor is capable of distinguishing a first signal received by the sensor from a second signal received by the sensor on the basis of modulation processes used in the generation of the first and second signals.

2. A connector according to claim 1 wherein the sensor causes operation of the first switch only upon detection of the second signal by the sensor.

3. A connector according to claim 2 wherein the switching action of the first switch is implemented through the use of field effect transistors.

4. A connector according to claim 1 wherein the first signal has a first current amplitude and the second signal has a second current amplitude which is higher than the first current amplitude.

5. A connector according to claim 1 wherein the second signal is at a higher level of modulation than the first signal.

6. A connector according to claim 1 which includes first and second switches which are respectively responsive to signals which have different levels of current modulation.

7. A connector according to claim 1 wherein operation of the first switch results in one of the following:

(i) one wire of the two-wire bus is open circuited and then closed, and (ii) both wires of the two-wire bus are open circuited and then closed.

* * * * *